US005798002A

United States Patent [19]

Gugel

[11] Patent Number: 5,798,002

[45] Date of Patent: Aug. 25, 1998

[54] METHOD OF AND DEVICE FOR PRODUCING CARBIDE AND CARBON SOLID SOLUTION CONTAINING SURFACE LAYERS

[76] Inventor: Saveliy M. Gugel, 109-10 Park Lane S., #B3, Richmond Hill, N.Y. 11418

[21] Appl. No.: 759,012

[22] Filed: Dec. 2, 1996

[51] Int. Cl.[6] ..... C23C 8/44; C23C 8/46

[52] U.S. Cl. ..... 148/209; 148/227; 148/242; 148/278; 266/120; 266/121

[58] Field of Search ..... 148/206, 209, 148/225, 227, 235, 242, 278; 266/121, 120

[56] References Cited

U.S. PATENT DOCUMENTS 4,202,705 5/1980 Komatsu et al. ..... 148/242

4,400,224 8/1983 Arai et al. ..... 148/242

5,234,721 8/1993 Rostoker et al. ..... 148/242

FOREIGN PATENT DOCUMENTS 1128378 7/1982 Canada ..... 148/242

*Primary Examiner*—Deborah Yee

*Attorney, Agent, or Firm*—Iiya Zborovsky

[57] ABSTRACT

In order to produce a carbon solid solution or carbide-containing surface layer on a substrate, the substrate is immersed into a cold bath of liquid active medium, and heated inside the liquid active medium by heating means immersed in the liquid active medium as well.

22 Claims, 9 Drawing Sheets

Diffusion of carbon in Steel Sample

SAMPLE #3

| mm | C% | S% |
|---|---|---|
| 0.0 TO 0.3 | NO REPORT | NO REPORT |
| 0.3 TO 0.5 | 2.67 | 0.034 |
| 0.5 TO 0.7 | 2.32 | 0.038 |
| 0.7 TO 0.9 | 2.02 | 0.040 |
| 0.9 TO 1.1 | 1.59 | 0.039 |
| 1.1 TO 1.3 | 0.82 | 0.036 |
| 1.3 TO 1.5 | 0.59 | 0.036 |
| 1.5 TO 1.7 | 0.57 | 0.037 |
| 1.7 TO 1.9 | 0.56 | 0.036 |
| 1.9 TO 2.1 | 0.58 | 0.035 |
| 2.1 TO 2.3 | 0.56 | 0.035 |
| 2.3 TO 2.5 | 0.56 | 0.036 |
| 2.5 TO 2.7 | 0.56 | 0.035 |

outer surface of carbide surface layer

Inner surface of carbide surface layer
On the core boundary

METHOD OF AND DEVICE FOR PRODUCING CARBIDE AND CARBON SOLID SOLUTION CONTAINING SURFACE LAYERS

BACKGROUND OF THE INVENTION

The present invention relates to metal treatment and more particularly, to an improved method and device for forming protective carbide and carbon-solid solution containing surface layers on metals, alloys, and superalloys in order to increase of antiwear, anti-erosive, anti-cavitative, antifrictive and anticorrosive properties. The invention is useful for all carbide formative elements of Mendeleevin Periodic Table of elements, and first of all for Fe and Ti base alloys and superalloys, and can be used for alloys and superalloys of such metals as Ni, Co, AL, Mg and Cu which are widely used in production.

Today metals, alloys, and superalloys are still main constructive materials which are widely used in different fields of machine building. In order to increase civil and military products reliability and longevity it is necessary to provide metal treatment for improving of resistance against wear, corrosion, erosion, cavitation, friction, and other negative environment influences. The carbon saturation of metal surfaces for forming carbide containing coatings is one of the most important and useful way in this direction.

Methods for forming carbide and carbon contained surface layers on different metals, alloys, and superalloys have been disclosed in U.S. Pat. Nos. 5,466,305; 5,234,721 and 4,698,237. U.S. Pat. No. 5,466,305 discloses a method of treating the surface of titanium to reduce the friction coefficient and wear loss without sacrificing its corrosion resistance. This method includes placing titanium in an atmosphere of a surface cleaning gas selected from the group consisting of hydrogen, argon and nitrogen to remove oxides on the titanium surface and subjecting the titanium to plasma-carburizing in an atmosphere containing hydrocarbon gas at a pressure of 0.5–15 Torr and a temperature 700°–1100° C. A surface layer is formed mainly composed of TiC. U.S. Pat. No. 5,234,721 discloses a method for forming carbide coating on a metal substrate selected from the group consisting of metals from Group IVA, VA, VIA and their alloys by heating in a bath of molten alkali or alkaline earth metal, containing from 2 to 20% of carbon under an inert gas atmosphere at temperature above 700° C. to 1100° after preparing a metal surface for carburization by heating the metals in a nitrogen-containing atmosphere for about two hours at a temperature of about 500° C. U.S. Pat. No. 4,698,234 discloses a metal surface hardening by carbide formation in which the surface is firstly coated with a colloidal dispersion of graphite and then locally melted in an inert atmosphere or vacuum, so that the molten metal reacts with the graphite to form a metal carbide. On resolidification, the metal carbide defines a dendritic carbide structure within the metal adjacent its surface.

SUMMARY OF THE INVENTION

Accordingly, it is an object of the present invention to provide a method of and a device for producing carbon and carbide containing surface layers on metals, alloys, and superalloys which have no restriction in form, shape, or dimensions of the treating parts and which is harmless, more simple and inexpensive i.e. more suitable for metal surfaces protection against wear, erosion, cavitation, corrosion, friction and other negative environment influences.

In keeping with these objects and with others which will become apparent hereinafter, the method of the invention includes forming carbide and carbon solid solution containing surface layers on all carbide forming metals, alloys and superalloys which are base or contain these carbide forming elements.

For this purposes the part to be surface treated is immersed into a liquid carbon containing active medium and its surface is heated by such internal sources of heating as inductive heating, ohmic heating by electric current running through the part, and electric contact heating. High concentration and precise demarcation of energy result in a very rapid surface heating and permit to reach quickly such high surface temperature as a melting temperature, and meanwhile the core temperature and it properties stay unchanged. The processing temperatures are selected in very wide intervals up to the surface melting point. The treated part can be fixed or moveable. During the processing the liquid active medium is dissociated directly on the surface heated to the high temperature, which produces a large amount of atomized highly active carbon and other alloying metallic and metalloid elements located in this matter. As a result, the carbon and alloying elements quantity (potential) and activity around these surfaces have a high value and the metal surface has a very high ability to absorption, diffusion, and chemical reaction with these active elements, which promotes a very quick carbides and carbon solid solutions formation into the surface being treated. After maintaining at the processing temperature in the active medium for the time required to obtain the desired dimensions and chemical composition of the surface layer, the cooling of product is performed in the same active liquid media, i.e. the liquid bath also serves as a quenching medium. Surface layers thickness can be varied from the micron range up to values greater than 15 millimeters in time period from several seconds to several minutes. In general the surface layer thickness depends on the frequency and power of electric current, processing temperature and time. After carburizing Fe base alloys and superalloys, the surface layers can be pure cementite, hypereutectic (carbides and ledeburite), eutectic (lebeburite), hypoeutectic (ledeburite and austenite or ledeburite and products of decomposed austenite) mixtures and pure austenite or products of its transformation as well. The surface layer microstructures of special metals, alloys, superalloys contain the correspondent carbides, carbon solid solutions, and other structural elements, whose peculiarities depend on the type of the alloy components, type of their interactions (phase diagram) and properties. Carbon and alloy elements content is a function primarily of heating rate and time at temperature. Similarly the transition zone can consist of a range of microstructure too.

The primary structure and properties of diffusion and transition zones are obtained after carburizing can be changed in desired direction by the following reheat treatment. If the surface of the part being treated is melted during processing, the keeping of fused surface layer on the part is done by using of optimal treatment parameters, cycling the surface heating, or by mechanical, electrical, and magnetic devices or combination of them which design depending on peculiarities of the part form and sizes, surface layer shape and dimensions, and type of heating.

This method promises to be competitive with such surface treatment methods as beam-line ion implantation, plasma source ion implantation (Psii), physical vapor deposition (PVD), chemical vapor deposition (CVD), diamondlike coatings, and other coating technologies which are used now.

There are broad applicability of this simple, comparatively inexpensive and harmless treatment method of forming general and local diffusive carbide surface layers on various metals, alloys, and superalloys for reliability and longevity improvement of military and civilian parts in the numerous areas in which wear, erosion, cavitation, corrosion, and friction (especially for Ti base alloys) resistance is a significant factor in the life of machines and tools.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

A method and a device in accordance with this invention are used to form general or local diffusive carbide and carbon solid solution containing surface layers on substrates which are either carbide forming metals, or alloys, and supperalloys are base or contain these elements. In this connection, it is noted that the term "metal substrate" as used herein, includes both these metals and their alloys and superalloys. The method and device of this invention have been demonstrated by the formation of carbide and carbon solid solution containing surface layers on Fe base alloys, but it is clearly understood that these type of surface layers can be formed on any carbide forming elements, alloys and superalloys containing these elements because of possibility to heat the substrate surfaces to any high temperature up to the melting point of these metals by internal sources of heating as used in the present invention.

The method of this invention in particularly suitable for forming carbide and carbon contained surface layers on all alloys and superalloys of carbide forming elements and can be used even for Ni, Co, Mg, AL, Cu base alloys and superalloys.

Figure 1:
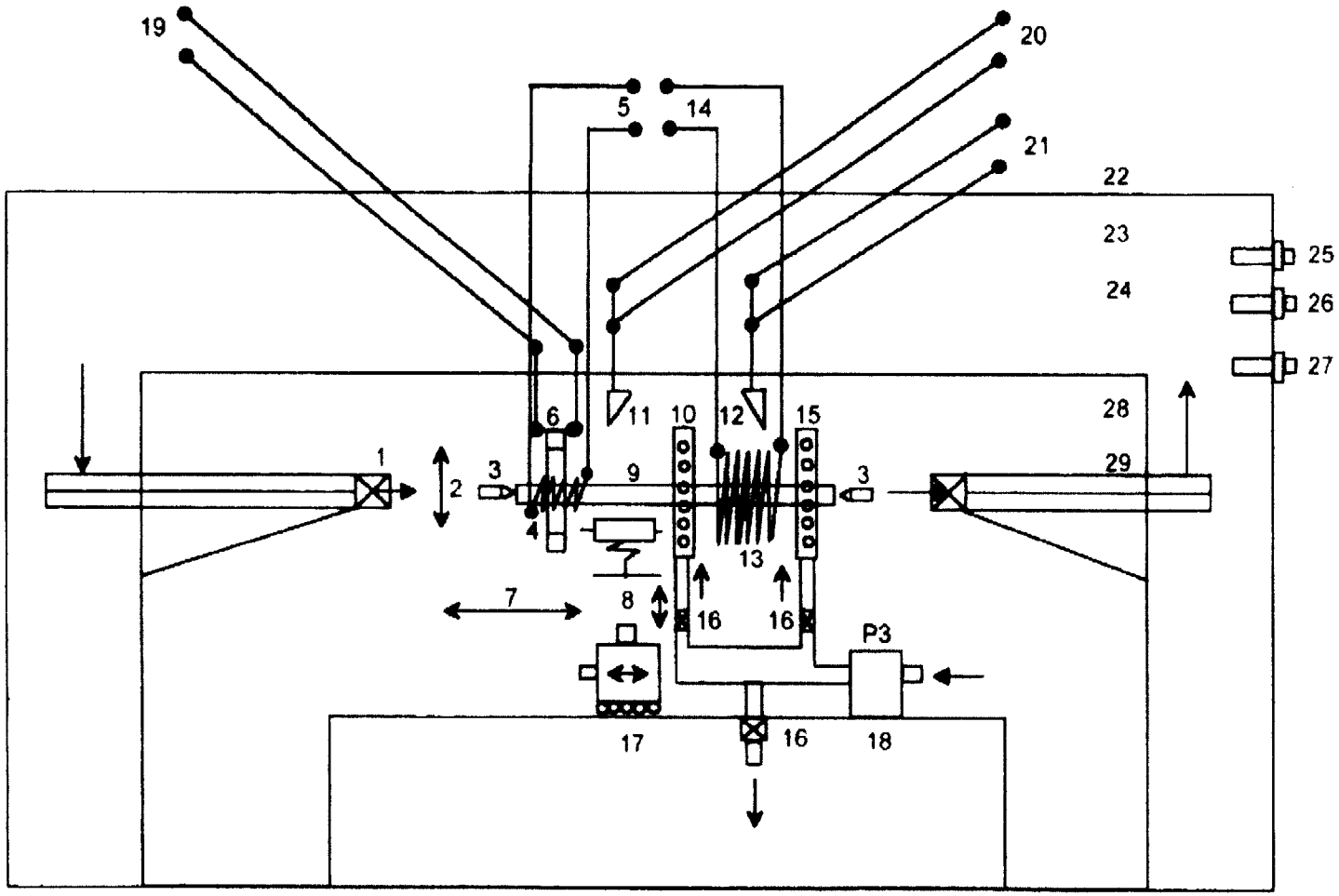
FIG. 1 is a view showing a device for forming carbide contained surface layers on various metals pins in accordance with the present invention by using of inductive heaters.

The method of this invention is carried out by providing a bath consisting of a cold carbon containing liquid active medium. This bath which is a main part of installation for forming carbide and carbon containing surface layers on various metals, alloys and suepralloys is shown in FIG. 1. All other parts of this installation including the heaters with all their connections from correspondent power supply are immersed into liquid medium. The device includes loading 1 and unloading 29 units, vertical 2 and linear 7 motion gears for a part, a handling unit 3, carburizing 4 and reheat treating 13 inductive heaters and their busworks 5 and 14, as well as electromagnetic unit 6 with it connection to a corresponding power supply or a mechanical unit 8 with its drive 17, used if it necessary to keep the fused surface layers, depending on peculiarities of part being treated. The part 9 is immersed into a liquid active medium and placed for convenient and efficient heating by a corresponding heater.

Figure 2:
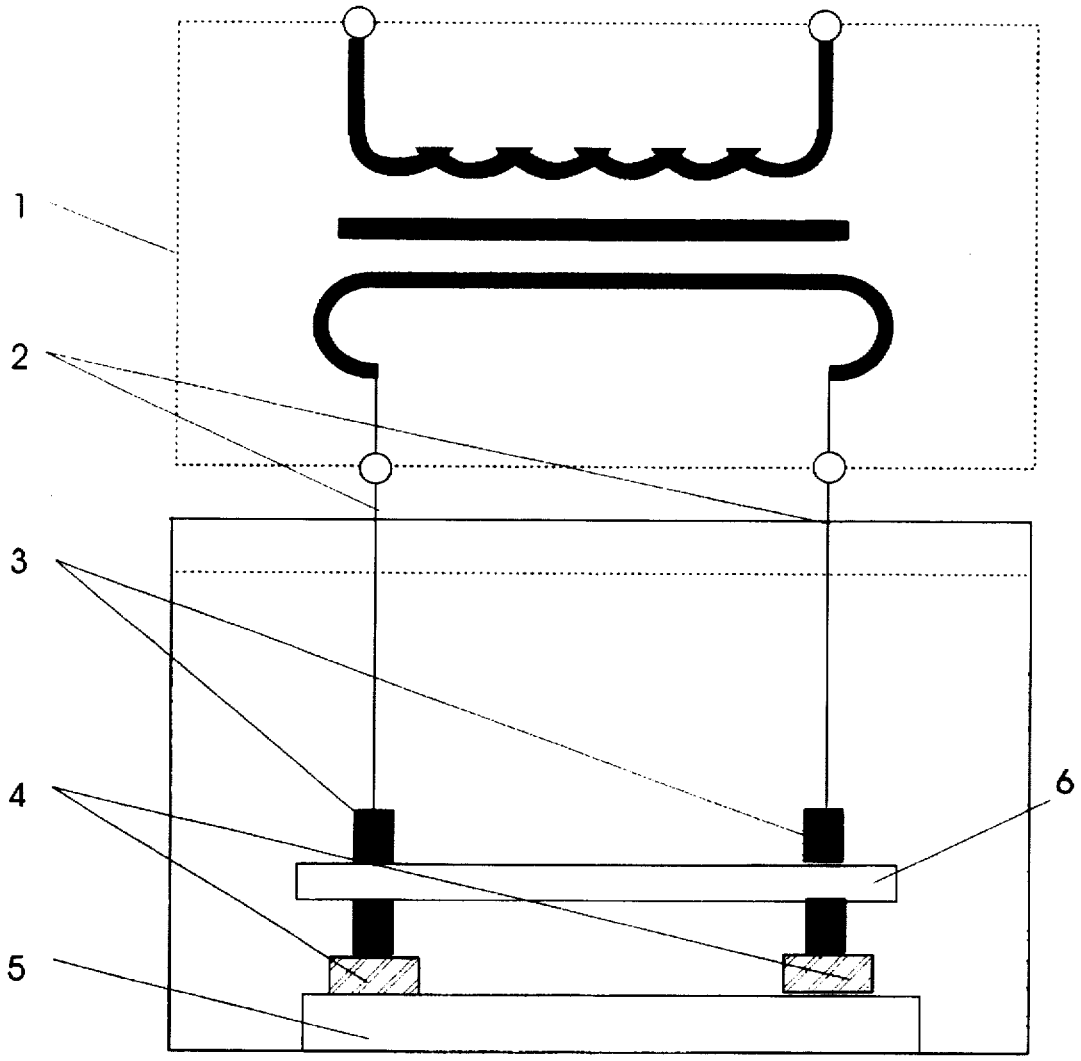
FIG. 2 is a view showing an ohmic resistive metal surface heating for forming carbide containing surface layers on various metals pins by electric current running through a part being treated in accordance with the persent invention.

The scheme of the ohmic resistive metal surface heating for forming the carbide and carbon solid solution contained surface layers by electric current running through the part is shown in FIG. 2. In this case electric current flows from transformer 1, through busworks 2 and contacts 3 mounted on the insulators 4 and base 5, through the part 6 and heats its surface.

In the cases when the surface contact heating is used, a standard spot and roller pressure electric machines can be used whose working parts are immersed in the liquid active medium. The type and design of the part loading and unloading devices, part moving gears, handling units and other necessary installation components are dependent on peculiarities of the part being treated.

When the heater power source is switched on the fixed or movable part surface is heated in the liquid medium to a corresponding processing temperature from temperature of the beginning of carbon interaction with metal matrix to it melting point (the highest critical temperature). The termperature of the heated surface during carburizing is measured, controlled and programmed by an infrared sensor 11 and remote-indicating recording instrument whose connections are points 20.

High concentration and precise demarcation of energy inside the heated surface, which is characteristic of inductive, conductive and resistive types of internal heating are used in inventive method and are main causes of very rapid surface heating so that it is possible to reach quickly a very high temperature up to the temperature of the melting point, while the core temperature and it properties stay unchaged. When the liquid medium comes into contact with the hot surface it decomposes and produces a large amount of atomized highly active carbon and other alloying elements located in this medium. As a result, the carbon and alloying elements quantity (potential) and activity around these surfaces have a very high value and hot metal surface has a very high ability for absorption, diffusion, and chemical reaction with these active elements are formed directly on this surface. During heating time the surface layer saturates intensively with carbon and other alloying elements from the active medium. It promotes a very quick carbides and carbon solid solutions formation in the surface being treated. After soaking at the processing temperature for the time required to obtain the desired dimensions and chemical composition of the surface layer, the heater power source is turned off and product is cooled in the same active medium, with or without the use of the cooling sprayer 10 to corresponding critical temperature whose value depends on the core or surface layer chemical composition and their desired properties. The surface layer thickness depends on the frequency and power of electric current, processing temperature and time mainly, and can be varied from the micron range up to tens of millimeters during the time of processing from several seconds to several minutes. After the carburizing, the surface layer microstructure contains the corresponding plain and alloyed carbides and carbon solid solutions and other structure elements whose chemical composition and properties depend on metal substrate and active liquid medium chemical composition and treatment parameters. In case of Fe base alloys and superalloys processing, the surface layer microstructure is pure cementite, hypereutectic (carbides and ledeburite), eutectic (ledeburite), and hypoeutectic (ledeburite and austenite or ledeburite and products of austenite decomposition) mixtures and pure austenite or products of its transformation, depending on the quantity of carbon and other elements, velocity of heating and cooling, and other treating parameters. Similarly the transition zone microstructure can be varied. It must be emphasized that the structure and properties of the base metal or core in all cases stay unchanged. If the surface of the part being treated is melted during processing, the keeping of the fused layer on the part is done by the using of optimal treatment parameters, cycling the surface heating, and by electrical, magnetic, and electromagnetic devices or combinations of them 6 which produce the lavitation force for these purposes and by mechanical device 8 whose design depends on peculiarites of the part form and sizes, surface layer shape and dimensions, and type of heating and heater design.

If necessary, the additional reheat treatment of both the substrate core and the carbide and carbon solid solution containing surface layers without removing from the liquid active medium can be done by carburizing 4 or reheat treating heater (or heaters) 13 supplied from the same or another power source, and sprayers 10 and 15. The temperature of the part surface in these cases can be measured, controlled and programmed by both the sensor 11 and a corresponding instrument connected to points 20, or the sensor 12 and a corresponding instrument connected to the points 21. The active media agitation and feeding of sprayers 10 and 15 are carried out by a pump 18. The part quenching after carburizing and its reheat treatment for refining of grains, hardening and tampering can be performed without removing from the active medium, i.e. it is possible to complete the whole treatment cycle in one place simultaneously. This feature reduces the cost of processing.

After treatment the part with local or total carbide and carbon containing surface is removed from the active medium which kept in a main tank 22. The active medium maximum 23 and minimum 24 levels are measured and controlled by corresponding devices 25 and 26 and its temperature in the zone of processing is measured and controlled by an instrument 27. All components of the device are mounted on a base 28 which is lowerable into the main tank 22.

Figure 3:
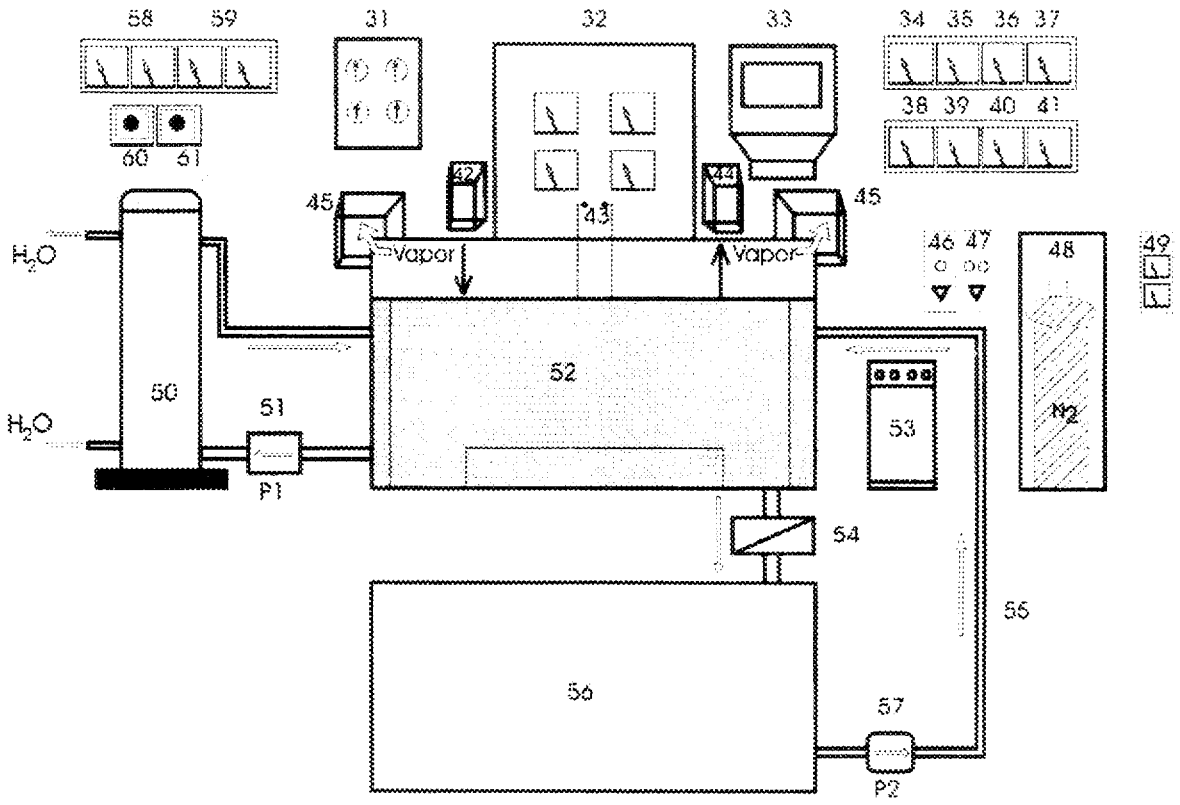
FIG. 3 is a view showing a system for forming in mass production carbide containing surface layers on various metals, alloys, and superalloys in accordance with the present invention.

All connections to corresponding power supplies and sensors are provided over the active medium. This design principle allows to connect easily all parts of device and to use it effectively. The whole system for realization of the processing method in mass or large-lot production shown in FIG. 3. It contains the device 52 mentioned above and other types of equipment necessary for forming carbide and carbon solid solution containing surface layers on various metal substrates. They include a power source for electric, magnetic or electromagnetic devices 31 which can be used for maintaining the melted surface layer, instead of limiter or mechanical devices, whose location is indicated by the instrument 49, a main power source 32 for production of sufficient power and frequency of current necessary for feeding of corresponding heater of internal heating through the power taps 43 with all means for measuring, controlling, and supporting all necessary power supply and processing parameters, a sysetm 33 for programming and controling the whole process cycle and all acting equipment parts functions, instruments for temperature measurements of active medium 34, metal part surface during carburizing 35 and reheat treatment 36. These are also an instrument 37 for measuring lavitation force produced by the device 31, an instrument 38 for measurement of a product revolution direction and velocity, it linear motion velocity 39, and location 40, a processing cycles counter 41, charging 42 and discharging 44 arrangements for products carried out in the liquid active medium. For properly using the active medium there are the corresponding ventilation system 45, sensors and instruments for measuring and controlling temperature 46 and levels 47, emergency devices 48 and 54. A heat exchanger 50 with instruments for measuring the active medium 58 and cooling medium 59 incoming and outgoing temperature, a main installation 52 which is put into the tank with active medium and an auxiliary tank 56 for active medium keeping and pouring, main 51 and auxiliary 57 pumps for the active medium circulation, pipelines 55 and devices for active medium analysis 60 and 61. The control of all systems is carried out from a control board 53.

Figure 4:
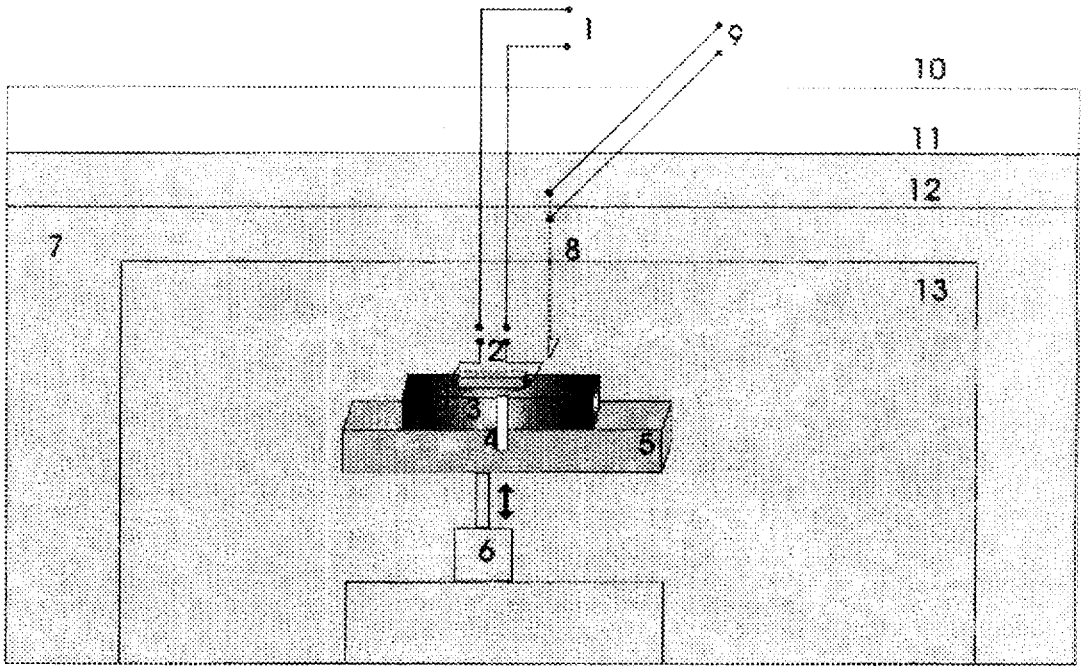
FIG. 4 is a view showing a device for forming carbide containing surface layer on various fixed flat metal parts by inductive heating in accordance with the present invention.
Figure 5:
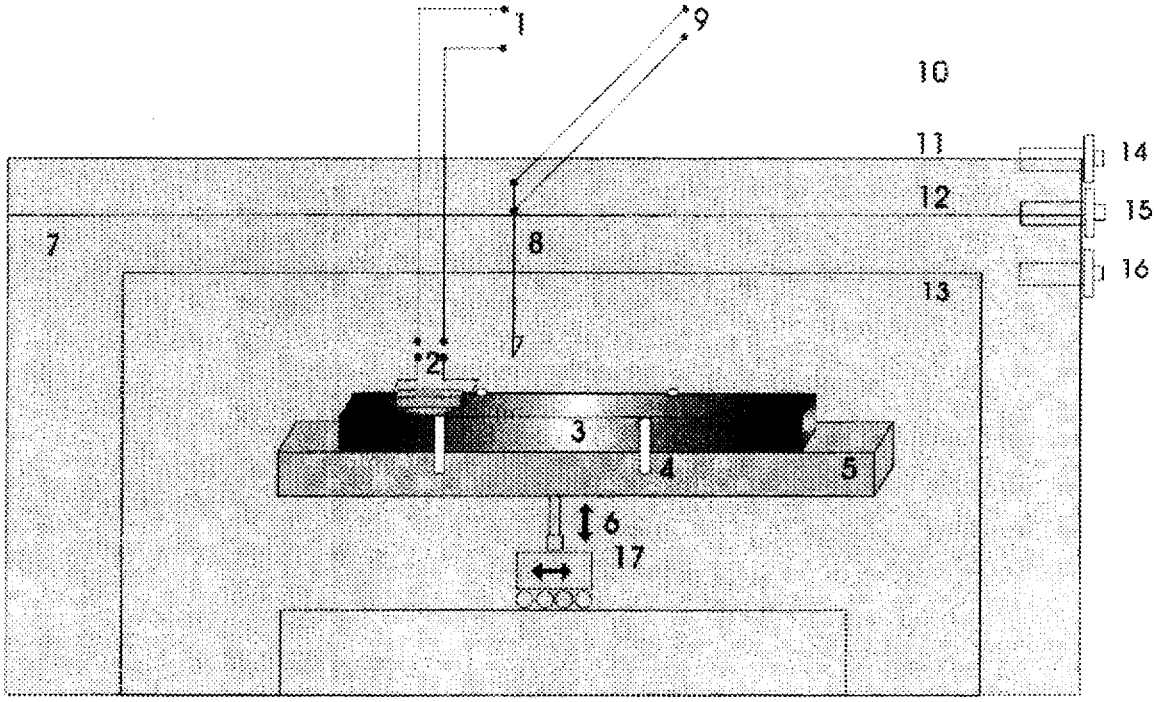
FIG. 5 is a view showing a device for forming carbide containing surface layer on various moving flat metal parts by inductive heating in accordance with the present invention.

The simplest installation for forming carbide containing surface layer on various fixed and moving metal parts in accordance with present invention is shown in FIG. 4 and FIG. 5 respectively. The buswork and water cooled leads 1 for connection between the power supply and inductive heater 2 provide the necessary power and frequency current for heating the part 3, fixed by a fixer 4 on the slotted bedplate 5 which have a vertical motion gear 6.

Surface temperature of the part is measured, controlled and programmed by an infrared sensor 8 which connected to a corresponding instrument by connections 9. All parts of the device are mounted on the base 13 located in the liquid active medium 7 pouring into the main tank 10. The maximum and minimum levels of the active medium in working conditions are identified as 11 and 12 respectively. The device shown in FIG. 5 is additionally provided with sensors and instruments for measuring and controlling of the maximum 14 and minimum 15 levels and temperature 16 of the active media, and with the instrument 17 for moving the part.

Figure 6:
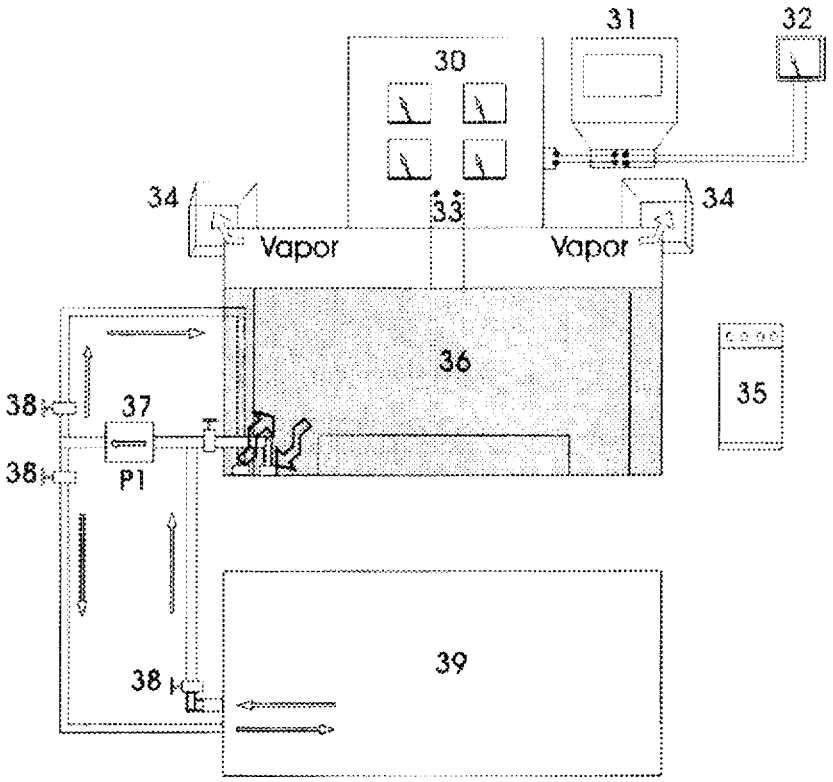
FIG. 6 is a view showing a simple system for forming carbide containing surface layers on various metals, alloys, and superalloys in individual and small-lot production in accordance with the present invention.
Figure 7:
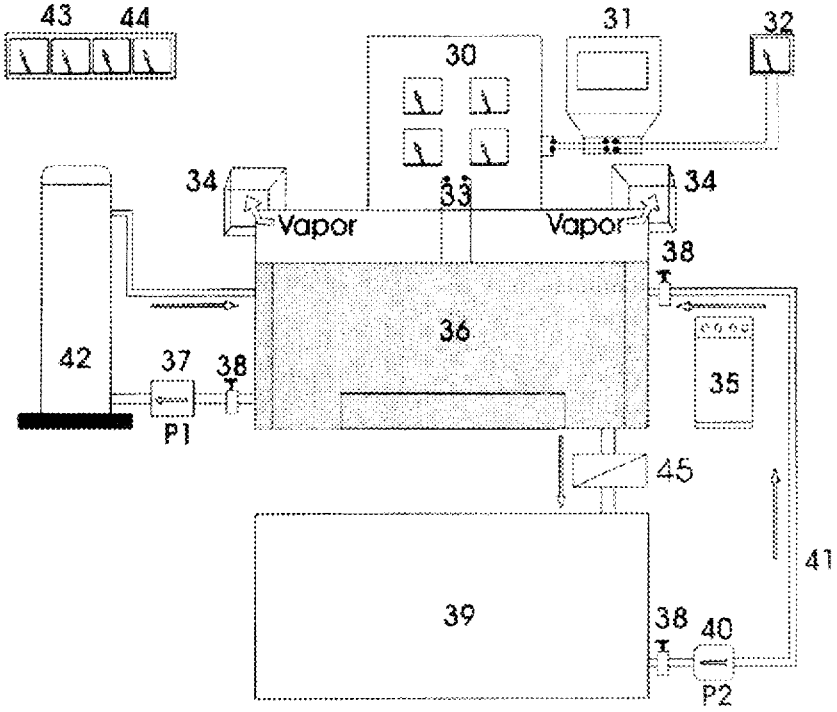
FIG. 7 is a view showing a simple system for forming carbide contained surface layer on various metals, alloys, and supperalloys in small and medium size production in accordance with the present invention.

The simplest systems for forming carbide and carbon solid solution containing surface layers on various metals, alloys and superalloys in individual, small, and medium size production in accordance with present invention are shown in FIG. 6 and FIG. 7 respectively. The main power source 30 supervised by devices 31 for handling the process parameters and 32 for part surface temperature supply corresponding power and frequency current to the heater of internal heating immersed in the active liquid medium, through the power taps 33, 34 is identify working zone ventilation tubes. Devices 36 for forming carbide and carbon solid solution containing surface layers on various metals, alloys, and superalloys, power source 30 and units 31 and 32 are controlled from a control board 35. The active medium can be directed by the main pump 37 and suitable manual valves 38 either from the main tank of the device 36 to the auxiliary tank 39 used for its pouring and storage or from the auxiliary tank to the main tank used for processing of the part. The system shown in FIG. 7 includes an auxiliary pump 40 and a pipeline 41 for active medium supply from the auxiliary tank to the main tank, heat exchanger 42 for active media cooling with corresponding instruments 43 and 44 for incoming and outgoing cooling and active media temperature control, and emergency unit 45 (jettison gear with electro-magnetic drive).

EXAMPLES

The present invention is illustrated by but not limited to the following exampels explaining the principles of invention. All percentages referred to herein are by weight and the temperatures are degrees centigrade unless otherwise indicated. The metal substrate specimens which are carburizid in accordance with the present invention were prepared for photomacrography and photomicrography by the following process. Each specimen after carburizing was sectioned, in a direction transverse to the carburized surface an then mounted, ground, polished and etched in accordance with standard metallographic practice.

Example 1

Figure 8:
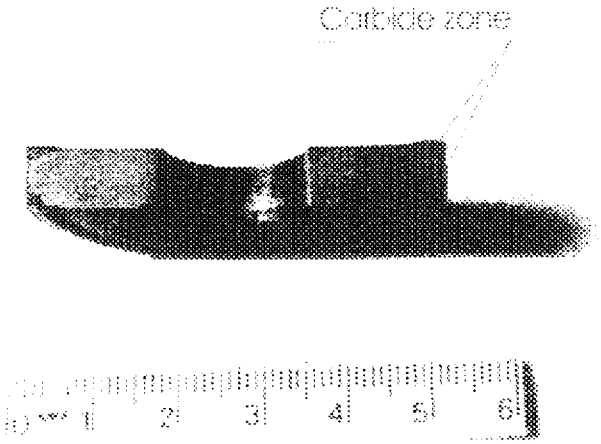
FIG. 8 is a view showing a photomacrograph of carbide containing surface layer on a cylinder sample (external diameter 47.5 mm, internal diameter 16 mm, height 7 mm) made from low alloy steel (carbon content 0.30%, silicon and manganese content about 1%) which was carburized in accordance with the present invention in a bath containing cold machine oil on the depth about 100 mm. Sample rotation velocity was 100 rpm. Induction heating by 70 khz high-frequency current, treatment time 5 sec.
Figure 9:
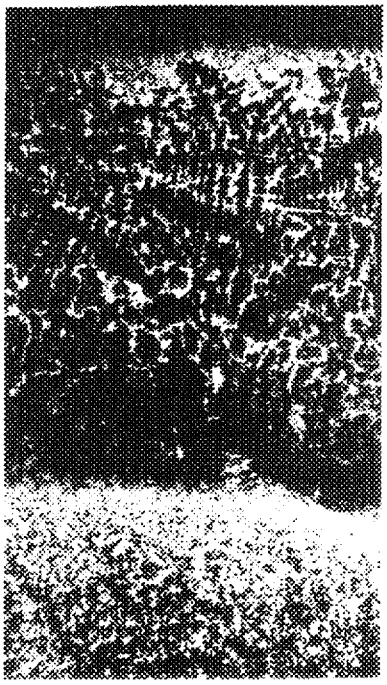
FIG. 9 is a view showing photomicrograph (75×) of carbide containing surface layer on the cylinder sample which photomacrograph introduced on FIG. 8.

The cylinder testing samples (external diameter 47.5 mm, internal diameter 16 mm, and height 7 mm) made from carbon steels (carbon content 0.45 and 0.50%) and low alloy steel (carbon content 0.30% silicon and manganese content about 1%) were treated in accordance with the present invention vertically in cylindrical inductor with internal diameter 50 mm and hegiht 8 mm. The sample and the inductor were immersed into machine oil so that the heated surface was under oil over about 100 mm. Samples were rotated with velocity from 50 to 150 revolution per minute. The power source had power 60 kw and frequency 70 khz. The treatment time was from 2 to 10 sec. After this processing, carbide containing surface layer was formed whose macrostructure and microstructure are shown in FIGS. 8 and 9. The roughness of cylindrical surface remained the same as before treatment. Wear resistance of treated samples obtained by testing on the Amsler wear testing machine was from two to five times greater than that of steels conventionally hardened and tempered to the same hardness, due to the larger amount of carbides ($Fe_3C$). Hardness of the treated surface layers was adjusted by different velocity quenching in the same active medium, conventional induction tempering or reheat hardening and tempering without removing the parts from the oil bath. In these cases surface hardness was 50–68 HRC.

Example 2

The pins of caterpillar chain (external diameters 21 and 26 mm, length 400 mm) made from carbon steel (carbon 0.56%) and two low alloy steels (carbon 0.30%, silicon and manganese about 1% and carbon 0.40% silicon and chromium about 1%) were treated in accordance with the present invention horizontally in a cylindrical inductor with diametral clearance about 2–2.5 mm. The pin and the inductor were immersed into fuel oil so that heated cylinder surface was under oil over about 100 mm.

The power source included oscillator high-frequency equipment (frequency 70 KHZ, output power 60 and 100 kw).

Figure 10:
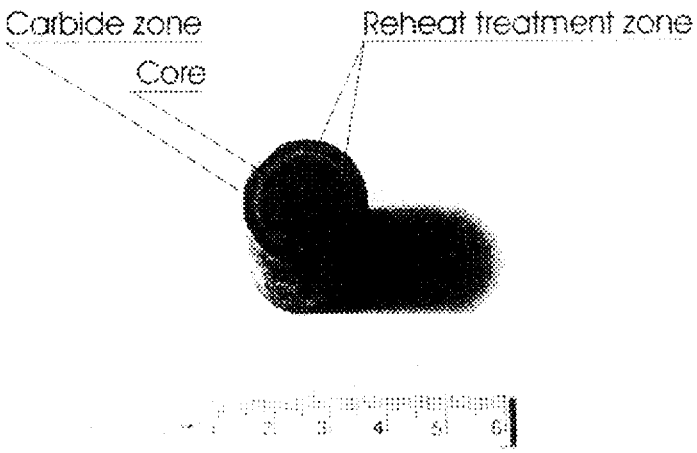
FIG. 10 is a view showing a photomacrograph of carbide containing surface layer on a tractor caterpillar chain pin (diameter 21 mm, length 400 mm) made from carbon steel (carbon content 0.56%) which was carburized in accordance with the present invention in a bath containig fuel oil on the depth about 100 mm. Pin rotation velocity was 80 rpm, horizontal moving velocity through inductor was 240 mm/min, induction heating by 70 khz high-frequency current.
Figure 11:
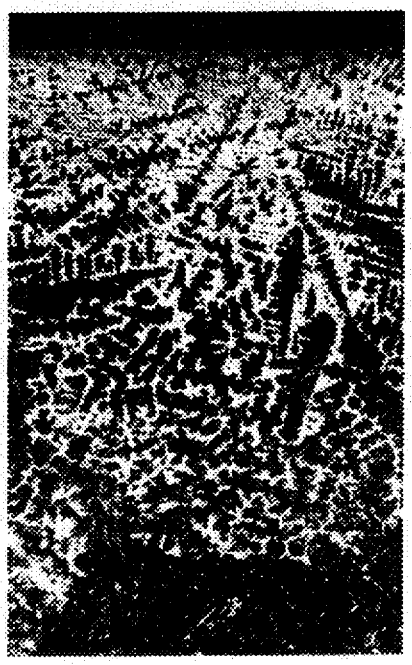
FIG. 11 is a view showing a photomicrograph (75×) of carbide containing surface layer on a tractor caterpillar chain pin which photomacrograph introduced on FIG. 10.
Figure 12:
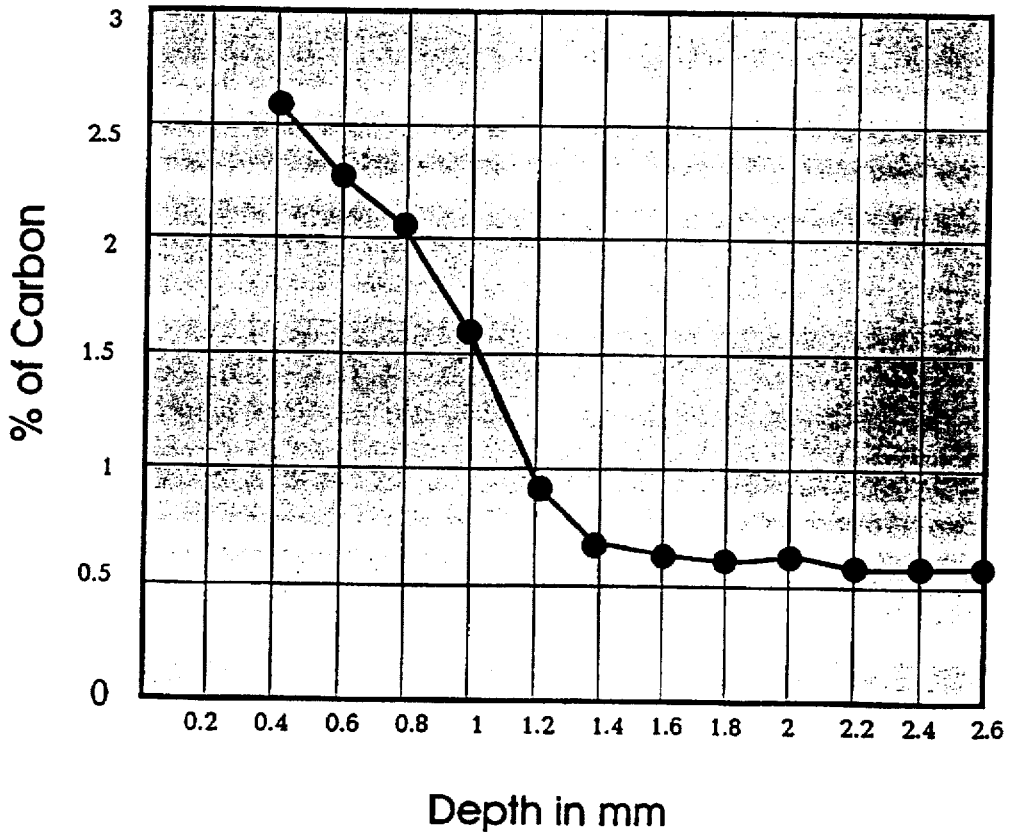
FIG. 12 is a view showing a graph which introduces results of quantitive depth analysis of carbon performed on a tractor caterpillar chain pin whose photomacrograph is shown on FIG. 10 and a photomicrograph introduced on FIG. 11.

During treatment the rotating and horizontally moving pin went through the heater, his surface was melting and diffusion surface layer forming. Melted surface layer was kept by mechanical device. By using such treatment parameters as pin rotation 80 rpm, and pin moving 240 mm/min, it diffusive carbide containing surface layer was obtained with thickness 1.4–1.6 mm. FIG. 10 shows the macrostructure of the pin with carbode zone, reheat-treatment zone, transition zone, and core. The microstructure of the surface layers directly beneath the treated surface included carbides, hypereutectic and eutectc lebedrite, then hypoeutectic ladeburite in the layers located beneath the surface, and then austenite with different types of ferrite-cementite mixtures and austenite and martensite (FIG. 11) accordingly with the carbon content in diffusion surface layer (FIG. 12). There is a transition zone between diffusive surface layer and core of pin. For further improvement of core transition zone, and diffusion surface layers microstructure and properties different kinds of high-frequency reheat treatment were used.

Wear resistance of these pins tested on special wear stand which imitated the caterpillar chain joint (testing parameters were: pin revolution—150 rpm, working load—150 kg, sand consumption 1.3 liter per minute) was in 2.5–3.0 times higher than high-frequency hardened pins with the same hardness. The wear of the track links made from austenitic Gatfild steel (manganese content about 13.0%) was more than twice less than in pairs with the heat treated pins. These results were confirmed by testing of more than 200 pins in service conditions.

Example 3

Figure 13:
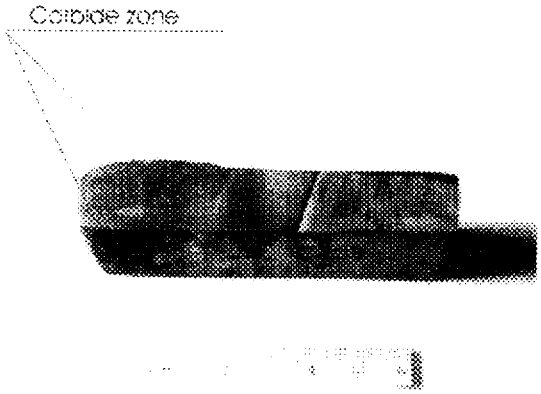
FIG. 13 is a view showing a photomacrograph of carbide containing surface layer on a plough field plate (rectangular plate 350×80×14 mm) made from plane carbon steel (carbon content about 0.4%) which was carburized in accordance with the present invention in a bath containing liquid organic compound triethanol amine or tris (2-hydroxyethyl) amine $(HOCH_2CH_2)_3N$ on the depth about 60 mm. The heating of the part was from 100 kw, 2.5 khz high-frequency equipment during 1.0 min. in flat inductor.

The plough field plate which was a flat rectangular plate 350×80×14 mm made from plain carbon steel (carbon content about 0.4%), has a very intensive abrasive wear in soil and very short life-time correspondingly. For increasing reliability and longevity of these parts a diffusion carbide surface layer was formed with the length 270–300 mm, width 20–25 mm, and thickness 4–6 mm. The cross-section of this part is shown in FIG. 13. For it formation the tube flat inductor was used with the corresponding dimensions which was immersed into liquid organic compound triethanol amine ($HOCH_2CH_2)_3N$ to the depth about 60 mm. The heating was from 100 kw, 2500 hertz high-frequency equipment during 0.5–1.5 min. Nitrogen diffused from active medium was found in these surface layers. The microstructure of this surface layer similar to the microstructures are obtained in previous and following examples.

The surface layers microstructure immediately after carburizing consisted of laminated ledeburite (50–60%) with regions of ferrite-cementite mixture located as small uniformly distributed dendrites. The dendrites quantity in ledeburite increased from the surface to the core, and the carbon content decreased from about 4.0% to 2.5%. In the diffusion zone beneath the ledeburite layers there was perlite-sorbite with cementite needles. This zone thickness was no more than 0.15 mm. On the boundary between the diffusion zone and the core ferrite-perlite overheated microstructure was found sometimes. After induction hardening and self tempering in the high-frequency installation (frequency 8.0 $KH_z$, output power 100 kw) or after volumetric furnace hardening at the 850°–870° C. and tempering at 200°–250° C. all traces of overheating were eliminated, and ferrite-cementite mixture was transformed into martensite-cementite (needle or globules) mixture. The initial Rockwell C surface hardness after carburizing was 54–57 and after the reheat treatment was raised to 65–67. The full-scale wear test in real service conditions of 125 carburized only plough field plates (HRC 50–54) results were 2.5–3.0 times increasing of wear resistance in comparison with the same parts after plain high-frequency hardening and tempering (HRC 49–55).

Example 4

Figure 14:
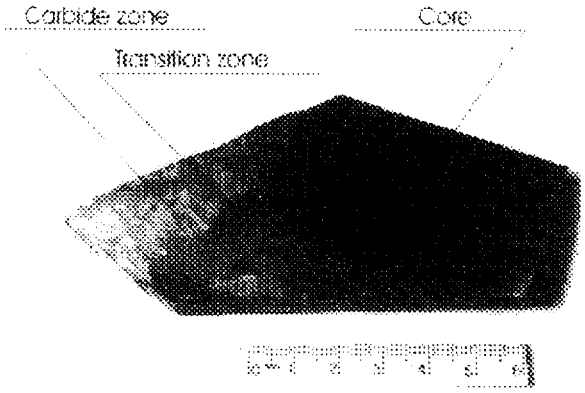
FIG. 14 is a view showing a photomacrograph of carbide containing surface layers on a cutter (length 120 mm, width 60 mm, thickness 12 mm) made from plain carbon steel (carbon content 0.45%) which was carburized in accordance with the present invention in a bath containing fuel oil on the depth about 120 mm. Induction heating by 8.0 KHZ high-frequency current during 1.5 min in flat inductor.
Figure 15:
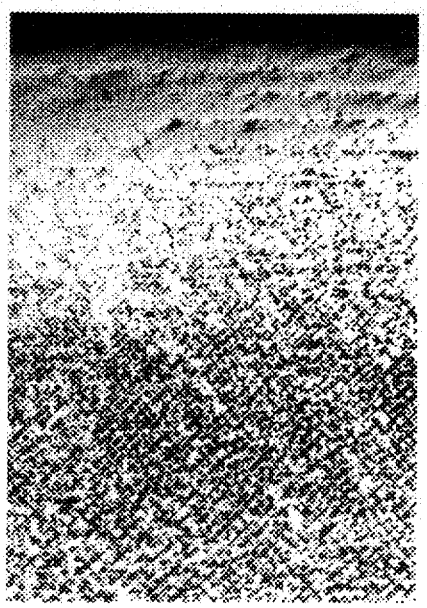
FIG. 15 are view showing microphotographs (20×) of carbide and carbon contained surface layer on a cutter whose photomacrograph is shown on FIG. 14.
Figure 15:
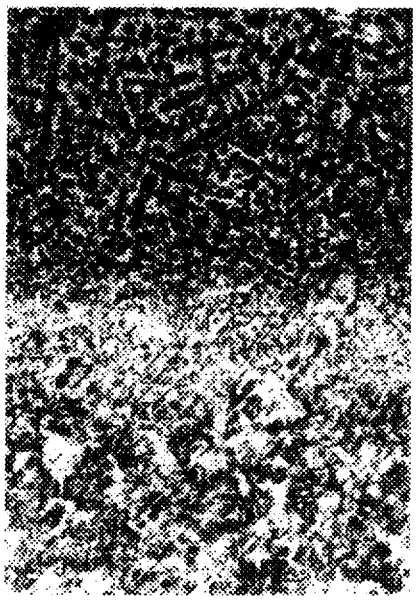

All types of working members for ditching, earth-moving and excavating machines have a very small lifetime because of very extensive abrasion wear in the soil. There are many difficulties in solution of this problem by existing hardening methods. The invented method was used for forming diffusive carbide surface layer (FIG. 14) on cutter plate (length –120 mm, width 60 mm, thickness 12 mm) made from plain carbon steel (carbon content 0.45%). The surface layer microstructure is shown in FIG. 15. The abrasion wear resistance of these surface layers obtained on the Kh4B testing machine by wearing of cylidner sample ends on the special grinding paper Bsh200E was equal to wearing of surfacing hard alloy "Sormait No. 1" (chemical composition: C=30%, Cr=30%, Ni=5%, Si=3%, balance Fe). The lifetime of the carburized milling cutters in real service conditions was 2–5 times higher than the cutters made from low alloy steel (C=0.65%, Mn=1%) with Rockwell C hardness 58–63 and cutters made from plain carbon steel (C=0.40%) and surfaced by hard alloy "Sormait No. 1."

It is important to notice that carburized cutters had both a good wear resistance and a self-sharpening ability over whole service time.

There are many other parts of different form, shape or dimensions which were processed by method for forming general and local diffusive carbide and carbon solid solution containg surface on various metals and alloys.

It will be understood that each of the elements described above, or two or more together, may also find a useful application in other types of constructions different from the types described above.

While the invention has been illustrated and described as embodied in method of and device for producing carbon solid solutions and carbide containing surface layers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing a surface layer selected from the group consisting of carbide containing surface layer and a carbon solid solution containing surface layer on a substrate selected from the group consisting of a metal and a metal containing an alloying element, the method comprising the steps of providing a bath composed of a cold carbon-containing liquid active medium at ambient temperature; introducing heating means into the cold liquid active medium; immersing a substrate into the cold liquid active medium; heating the substrate directly by the heating means inside the liquid active medium to a corresponding processing temperature until the layer of a desired chemical composition and thickness is formed on the substrate.

2. A method as defined in claim 1; and further comprising cooling the substrate with the layer in the same active liquid medium after the formation of the layer.

3. A method as defined in claim 2; further comprising reheat treating a substrate core and the layer without removing from the liquid active medium.

4. A method as defined in claim 1; and further comprising selecting the carbon-containing liquid active medium from the group consisting of a liquid petroleum product and an organic compound.

5. A method as defined in claim 1; and further comprising selecting the metal substrate from the group consisting of a metal and a metal containing an alloying element which contains at least one metal element selected from the group consisting of Be, Mg, B, AL, Si, Y, Ti, Zr, Hf, V, Nb, Ta, Cr, Mo, W, Mn, Fe, Co, Ni and Cu.

6. A method as defined in claim 1; and further comprising selecting the substrate from a metal which is an element located in the groups of Mendeleevin periodic table IIa, IIIa, IVa, IIIb, IVb, Ib, Vb, VIb, VIIb, and VIIIb.

7. A method as defined in claim 1; and further comprising selecting the substrate from a metal with an alloying element selected from the group consisting of Li, Be, B, Si, Sc, Y, La, Ti, Zr, Hf, V, Nb, Ta, Cr, Mo, W, Mn, and Fe.

8. A method as defined in claim 1; and further comprising selecting a material of the substrate from a metal with an alloying element located in the groups of Mendeleevin periodic table, Ia, IIa, IIIa, IVa, IIIb, IVb, Vb, VIb, VIIb, and VIIIb.

9. A method as defined in claim 1; and further comprising selecting the heating means from the group consisting of inductive heating means, ohmic heating means, conductive heating means, and contact heating means.

10. A method as defined in claim 1; and further comprising heating means operating by heating selected from the group consisting of inductive heating, flowing electric current through the substrate, electrically contacting the substrate, and resistive heating of the substrate.

11. A method as defined in claim 3; and further comprising using the active liquid medium for quenching after the reheat treating.

12. A method as defined in claim 4; and further comprising selecting the carbon-containing liquid active medium from the group consisting of a liquid petroleum product and an organic compound which contains at least one alloying element selected from the group consisting of Li, Be, B, Si, Sc, Y, La, Ti, Zr, Hf, V, Nb, Ta, Cr, Mo, W, Mn and Fe.

13. A method as defined in claim 4; and further comprising selecting the carbon-containing liquid active medium from the group consisting of a liquid petroleum product and an organic compound which contains at least one alloying element located in the groups of Mendeleevin periodic table Ia, IIa, IIIa, IVa, IIIb, IVb, Vb, VIb, VIIb, VIIIb.

14. A method as defined in claim 12; and further comprising selecting the carbon-containing liquid active medium which contains at least one alloying element which is disolved, diluted, emulsified, and mixed in this medium.

15. A method as defined in claim 1; and further comprising using the process temperatures from a temperature of a beginning of carbon dissolution in the substrate to a melting point of the substrate.

16. A method as defined in claim 1; and further comprising keeping a fused surface layer produced on the substrate by means selecting from the group consisting of using optimal treatment parameters, cycling of the heating of a surface of the substrate, using devices selected from the group consisting of mechanical, electrical and magnetic devices, and a combination thereof.

17. A device for producing a surface layer from the group consisting of a carbon solid solution containing surface layer and a carbide containing surface layer on a substrate selected from the group consisting of a metal and a metal containing an alloying element, comprising means forming a bath composed of a cold carbon-containing liquid active medium at ambient temperature, so that a substrate can be emmersed into the cold liquid active medium; and heating means introduced in the liquid active medium and directly heating the substrate inside the liquid active medium when both the substrate and the heating means are located in the liquid active medium.

18. A device as defined in claim 17; and further comprising cooling means located in the liquid active medium and cooling the substrate when both the substrate and the cooling means are located in the liquid active medium.

19. A device as defined in claim 17; and further comprising reheat treatment means located in the liquid active medium and reheat treating the substrate with carbide and carbon solid solution contained surface layer when both the substrate and the reheat treating means are located in the liquid active medium.

20. A device as defined in claim 17; and further comprising means selected from the group consisting of mechanical, electrical, magnetic and combined means for keeping a fused surface layer on the part during treatment.

21. A method as defined in claim 1; and further comprising the step of alloying a surface layer on the substrate from the carbon-containing liquid medium.

22. A method as defined in claim 1; and further comprising the step of alloying a surface layer on the substrate from a core of the substrate by diffusion of an element contained in the substrate.

* * * * *